US005902357A

United States Patent [19]

Riegels et al.

[11] Patent Number: 5,902,357

[45] **Date of Patent: *May 11, 1999**

[54] COMPOSITION FOR DYEING OR PRINTING TEXTILE MATERIALS

[75] Inventors: Martin Riegels, Leichlingen; Uwe Vogt, Monheim; Klaus Walz, Leverkusen; Fritz Lesszinsky, Gladbach; Bernd Könemund, Leichlingen; Torsten Groth, Odenthal; Winfried Joentgen, Köln, all of Germany

[73] Assignee: Bayer Aktiengesellschaft, Leverkusen, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/920,233

[22] Filed: Aug. 25, 1997

[30] Foreign Application Priority Data

Aug. 30, 1996 [DE] Germany ..... 196 35 061

[51] Int. Cl.[6] ..... D06P 1/38; D06P 1/52

[52] U.S. Cl. ..... 8/529; 8/543; 8/918; 8/922; 8/924; 8/926; 8/927; 8/928; 8/557

[58] Field of Search ..... 8/557, 543–549, 8/918, 529, 532, 922, 924, 926, 927, 928

[56] References Cited

U.S. PATENT DOCUMENTS

| | | | |
|---|---|---|---|
| 3,846,380 | 11/1974 | Fujimoto et al. | 260/78 A |
| 3,927,204 | 12/1975 | Neri et al. . | |
| 4,314,808 | 2/1982 | Jacquet et al. | 8/405 |
| 4,363,797 | 12/1982 | Jacquet et al. . | |
| 4,839,461 | 6/1989 | Boehmke . | |
| 5,041,291 | 8/1991 | Bader et al. . | |
| 5,131,768 | 7/1992 | Shimura et al. | 400/202 |
| 5,175,285 | 12/1992 | Lehmann et al. . | |
| 5,288,783 | 2/1994 | Wood . | |
| 5,296,578 | 3/1994 | Koskan et al. . | |
| 5,408,029 | 4/1995 | Wood et al. | 528/328 |
| 5,519,110 | 5/1996 | Wood et al. | 528/363 |
| 5,580,355 | 12/1996 | Groth et al. | 8/94.33 |
| 5,639,832 | 6/1997 | Kroner et al. . | |

FOREIGN PATENT DOCUMENTS

| | | | |
|---|---|---|---|
| 2192256 | 6/1997 | Canada | C08G 69/08 |
| 0274127 | 7/1988 | European Pat. Off. . | |
| 0406623 | 1/1991 | European Pat. Off. . | |
| 0519119 | 12/1992 | European Pat. Off. . | |
| 0593187 | 4/1994 | European Pat. Off. . | |
| 0648241 | 4/1995 | European Pat. Off. . | |
| 2253190 | 5/1973 | Germany | C08G 20/08 |
| 4307114 | 9/1994 | Germany . | |
| 4439990 | 5/1996 | Germany | C14C 3/18 |
| 19545678 | 6/1997 | Germany | C08G 69/08 |
| 1404814 | 9/1975 | United Kingdom . | |

OTHER PUBLICATIONS

Derwent Abstract of JP 09207 427 (Aug. 12, 1997).

J. Kovacs, et al., Chemical Studies of Polyaspartic Acids, vol. 26, pp. 1084 1091, (1961).

*Primary Examiner*—Margaret Einsmann

*Attorney, Agent, or Firm*—Sprung Kramer Schaefer & Briscoe

[57] ABSTRACT

Improved compositions for dyeing or printing textile materials of natural or synthetic fibers or mixtures of the two comprise polyaspartic acid or a derivative thereof and, if appropriate, wetting agents, emulsifiers, leveling agents, dispersing agents, reducing agents, oxidizing agents, solubilizing agents, defoamers, reist agents, pH regulators, complexing agents or several of these as further components.

9 Claims, No Drawings

COMPOSITION FOR DYEING OR PRINTING TEXTILE MATERIALS

BACKGROUND OF THE INVENTION

The present invention relates to compositions for dyeing or printing textile materials of natural or synthetic fibers or mixtures thereof, which have a content of polyaspartic acid (PAA) or a derivative thereof. The invention furthermore relates to a process for dyeing or printing these textile materials using the compositions according to the invention, and the use of these compositions for dyeing or printing the textile materials mentioned.

In the course of dyeing processes on textile materials of natural and/or synthetic fibers or during printing of these textile materials, problems of a varying nature frequently occur, for example in respect of the levelness, the stability of the liquors or printing pastes or the formation of running creases. In most cases, a satisfactory solution to these problems has been successfully arrived at by addition of auxiliaries which it has been possible to optimize for the problem referred to. In most cases, however, the biological degradability of the auxiliaries employed is unsatisfactory, leading to heavy pollution of the particular waste waters. Examples of auxiliaries with an inadequate biological degradability are sulfonated naphthalene-formaldehyde condensates, oxyethylated fatty amines, ligninsulfonates and polymers or copolymers of (meth)acrylic acid.

SUMMARY OF THE INVENTION

It has now been found that successful dyeings or prints can be produced if auxiliaries which comprise PAA or a derivative thereof and, if appropriate, other known components, are added to the dyebaths (liquors) or printing pastes. PAA and its derivatives are distinguished by an outstanding biological degradability.

The invention accordingly relates to compositions for dyeing or printing textile materials of natural or synthetic fibers or mixtures of the two, which comprise polyaspartic acid (PAA) or a derivative thereof and, if appropriate, comprise wetting, agents, emulsifiers, leveling agents, dispersing agents, reducing agents, oxidizing agents, solubilizing agents, defoamers, resist agents, pH regulators, complexing agents or several of these as further components.

The invention furthermore relates to a process for dyeing or printing the textile materials mentioned by treatment of these textile materials with dye liquors or printing pastes which comprise dyeing or printing auxiliaries, wherein these auxiliaries comprise PAA or a derivative thereof and, if appropriate, one or more of the abovementioned components as further components, the auxiliaries being employed in an amount of 0.2 to 10% by weight, based on the weight of the goods (weight of the textile materials).

The invention also relates to the use of the compositions mentioned as auxiliaries for dyeing or printing the textile materials mentioned.

DETAILED DESCRIPTION OF THE INVENTION

The compositions according to the invention are characterized above all by their content of PAA or a derivative thereof. Possible derivatives are, above all, salts of PAA which contain $Li^{\oplus}$, $Na^{\oplus}$, $K^{\oplus}$, $Mg^{\oplus\oplus}$, $Ca^{\oplus\oplus}$, $NH_4^{\oplus}$, $H_3N(CH_2CH_2OH)^{\oplus}$, $HN(CH_2CH_2OH)_2^{\oplus}$ or $HN(CH_2CH_2OH)_3^{\oplus}$ as cations. The preparation and use of PAA and its derivatives has been the subject matter of numerous publications and patents for a long time. In this context, reference may be made to J. Org. Chem. 26 (1961), 1084, U.S. Pat. No. 4,839,461 (=EP 256 366), DE-A 22 53 190, U.S. Pat. No. 5,296,578, U.S. Pat. No. 5,288,783, EP 593 187, DE-A 42 21 875, DE-A 49 00 020 and DE-A 43 07 114.

The U.S. '461 mentioned describes the preparation of PAA from maleic anhdyride, water and ammonia. Maleic anhydride is converted into the monoammonium salt in an aqueous medium with the addition of concentrated ammonia solution. In a preferred embodiment, PAA is prepared by subjecting maleic acid monoammonium salt to thermal polymerization, optionally carried out continuously, preferably at 150 to 180° C. in a reactor over a residence time of 5 to 300 minutes, and converting the resulting polysuccinimide into PAA or a salt thereof by hydrolysis.

In a preferred embodiment, the PAA essentially contains recurring succinyl units of the following structure:

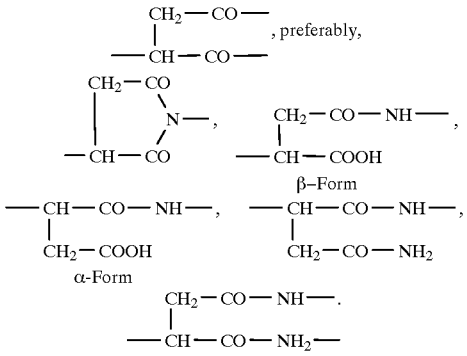

By a suitable reaction procedure and choice of edducts, the product can additionally contain further recurring units, for example a) Malic acid units of the formula

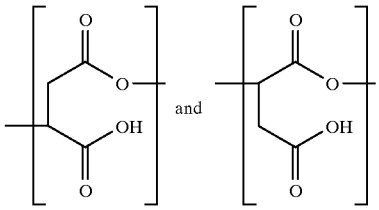

b) Maleic acid and fumaric acid units of the formula

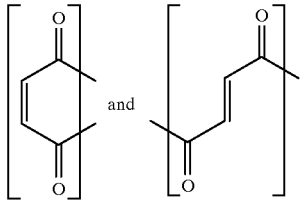

The chemical structure is preferably analyzed by $^{13}C$-NMR, FT-IR and, after total hydrolysis, by HPLC, GC and GC/MS.

In many preparation processes, it is not the pure acids but the corresponding anhydrides, for example polysuccinimide, which are initially obtained. Such polymerization products can be converted into a PAA-containing salt by reaction with a base, if appropriate in the presence of water. This conversion of PSI-containing polymers into PAA-containing polymers is subsequently effected in a suitable device by hydrolysis. A pH of between 5 and 14 is preferably suitable here. In the particularly preferred form, a pH of 7 to 12 is chosen, in particular by the addition of a base. Suitable bases are alkali metal and alkaline earth metal hydroxides or carbonates, such as, for example, sodium hydroxide solution, potassium hydroxide solution, sodium carbonate or potassium carbonate, ammonia and amines, such as triethylamine, triethanolamine, diethylamine, diethanolamine, alkylamines and the like. In addition to the free acids, Na, K or Ca salts thereof are particularly preferred.

The temperature during, the hydrolysis is suitably in a range up to and including the boiling point of the PSI suspension, and is preferably 20 to 150° C. If appropriate, the hydrolysis is carried out under pressure.

However, it is also possible to obtain the free polyaspartic acid by purely aqueous hydrolysis or treatment of the salt with acids or acid ion exchangers. In the present invention, the term "polyaspartic acid" (=PAA) also includes the salts, unless expressly stated otherwise. The finished product is obtained by drying, preferably spray drying.

Preferred polymers have a molecular weight, according to analyses by gel permeation chromatography, of Mw=500 to 10,000, preferably 700 to 5000, particularly preferably 1000 to 4500. In general, the proportion of the beta-form is more than 50%, preferably more than 70%.

In addition to the salts with the abovementioned cations, polysuccinimide can be employed as a derivative of PAA, this being carried out at elevated temperature, preferably at 100 to 240° C., if appropriate in the presence of a catalyst, such as in an amount of 0.01 to 1% by weight, based on the PAA, of an acid catalyst, such as sulfuric acid, phosphoric acid, methanesulfonic acid and others. However, polysuccinimide is also obtained directly in a number of preparation processes. In such a case, polysuccinimide can be converted into a salt with one of the abovementioned cations by reaction with a base, if appropriate in the presence of water. This conversion is effected after the preparation process in a suitable device by hydrolysis. A pH of between 5 and 14 is preferred here, preferably pH=7 to 12.

Suitable bases for carrying out an alkaline hydrolysis are alkali metal and alkaline earth metal hydroxides or carbonates, such as, for example, sodium hydroxide solution, potassium hydroxide solution, sodium carbonate or potassium carbonate, or furthermore ammonia and amines, such as triethylamine, triethanolamine, diethylamine, diethanolamine and ethanolamine.

Further derivatives of PAA which can be employed according to the invention are those in which some of the carboxyl groups present in the PAA are in the form of amides. Such PAA amides can be prepared from the polysuccinimide mentioned with primary or secondary amines (DE-A 22 53 190, EP 274 127, EP 406 623, EP 519 119, U.S. Pat. No. 3,846,380, U.S. Pat. No. 3,927,204 and U.S. Pat. No. 4,363,797). The residual succinimide structures which remain after the amide formation can then be converted into free carboxyl or carboxylate groups by the hydrolytic opening mentioned, in the presence of bases. In preferred derivatives, 5 to 50 mol %, preferably 10 to 35 mol %, of the aspartic acid units present contain such amide structures, while the remaining carboxyl groups are present in the form of carboxylate groups.

The compositions according to the invention comprise 5 to 100% by weight, preferably 10 to 50% by weight, of PAA, its derivatives (preferably its salts and amides) or mixtures thereof, based on the total weight of the compositions according to the invention. The amide groups of PAA derivatives contain, on the amide nitrogen, saturated or unsaturated aliphatic radicals having 2 to 20 C atoms, which can be substituted by hydroxyl groups, or cycloaliphatic radicals having 6 to 12 C atoms. Examples of such radicals in the amide groups are: hydroxyethyl, hydroxypropyl, butyl, hexyl, octyl, dodecyl, tetradecyl, hexadecyl, octadecyl, octadecenyl or cyclohexyl.

In addition to their content of PAA or a derivative thereof, the compositions according, to the invention can comprise further components. The further components include wetting agents, emulsifiers, dispersing agents or a mixture of several of these, which can be anionic or nonionic in a known manner. Examples of these are: reaction products of aliphatic, araliphatic or aromatic hydroxy compounds, carboxylic acids, carboxylic acid amides or amines with ethylene oxide, sulfuric acid half esters or phosphoric acid partial esters thereof, fatty acid esters of mono- or polysaccharides or fatty acid sorbitan esters and oxyethylation products thereof, $C_{10}$–$C_{20}$-alkanesulfonates, $C_8$–$C_{12}$-alkylbenzenesulfonates, $C_8$–$C_{18}$-alkyl sulfates or phosphates, or condensed aromatic sulfonic acids, such as naphthalene-formaldehyde-sulfonates. Substances of the type mentioned can also serve as leveling a(gents. They are known to the expert for these uses.

Solubilizing agents as further components are, for example, glycols, mono- to tetraalkylene glycols and ethers or esters thereof with $C_1$–$C_4$-alcohols or $C_1$–$C_4$-carboxylic acids.

Defoamers as further components are, for example, defoamers comprising vegetable oils or mineral oils, in particular propylene oxide/ethylene oxide block polymers.

Reducing agents, oxidizing agents, resist agents, pH regulators, complexing agents or several of these can occasionally be present in an amount of 0 to 10% by weight, based on the total weight of the compositions according to the invention, which is taken into account in the amount of PAA and the abovementioned surfactants. The use of such agents is familiar to the expert and described, for example, in Chwala/Anger, Handbuch der Textilhilfsmittel, [Handbook of textile auxiliaries], Verlag Chemie, Weinheim 1977.

The further components mentioned and their preparation and availability are known as such to the expert. Several of the further components mentioned can of course also be employed to achieve optimized dyeings or textile prints.

In a preferred manner, at least one of the further components is present. They are present according to the invention in an amount of 95 to 0% by weight, preferably 90 to 50% by weight, based on the total weight of the compositions according to the invention.

Textile materials which can be dyed or printed using the compositions according to the invention are fiber materials of loose fibers, combed slivers, woven or knitted goods or those in the form of nonwovens of natural or synthetic fibers or mixtures thereof. Examples of natural fibers which may be mentioned are wool, silk, linen, cotton or regenerated cotton, as well as jute or sisal. Examples of synthetic fibers which may be mentioned are those of polyesters, polyamides, polyurethanes, polyacrylonitrile or polypropylene.

The dyeing or printing of the textile materials is carried out with the dyestuffs suitable for the fibers employed, which is known in principle to the expert. Suitable classes of dyestuffs for this originate, for example, from the group of acid dyestuffs, metal complex substances which are free from sulfo groups or contain sulfo groups, reactive dyestuffs, vat dyestuffs, direct dyestuffs, sulfur dyestuffs, cationic dyestuffs, disperse dyestuffs and pigments.

The compositions according to the invention are preferably employed in the dyeing of cotton with direct dyestuffs and reactive dyestuffs, in the dyeing of polyester fibers with disperse dyestuffs or in the dyeing of cotton/polyester blend articles with direct or reactive dyestuffs and disperse dyestuffs. Dyeing or printing of the textile materials mentioned is carried out in known processes, such as in the exhaust process, in the continuous process, in the cold pad-batch (CPB) process and others, and in the context of the textile printing processes known to the expert. The amounts of textile auxiliaries to be employed in the individual processes, the temperatures to be used and the liquor lengths and concentrations are known to the expert. The compositions according to the invention are employed in an amount of 0.2 to 10% by weight, based on the weight of goods of the textile material to be dyed or to be printed.

Outstandingly stable dyebaths, and as a result in turn dyeings with outstanding levelness and brilliance, are obtained with the aid of the compositions according to the invention. In addition, the formation of running creases is reduced or avoided completely. Corresponding advantages are also obtained in textile printing. The polyacrylate, which is not environment-friendly and is otherwise employed as a thickener in dyeing or printing auxiliaries, can be replaced entirely or in part by the compositions according to the invention.

The compositions according to the invention have an outstanding biological degradability and therefore contribute to a reduction in the waste water load of textile plants. In the case where some or all the polyacrylate is replaced, lower viscosity dye liquors are furthermore obtained.

EXAMPLE 1

100 g of bleached cotton yarn were dyed in a cheese dyeing apparatus in a liquor ratio of 1:10 at 80° C., a dye liquor which comprised 4 g of Reactive Green 021 and 2 g of the auxiliary described below per liter being employed. After a dyeing time of 10 minutes, 80 g of sodium chloride were added, after a further 30 minutes, 5 g of sodium bicarbonate were added, and after 30 minutes 10 g of sodium carbonate were finally added. Dyeing was completed in a further 60 minutes. A dyeing of outstanding levelness was obtained, and no filter effects at all were to be seen on the bobbin.

The auxiliary employed consisted of an aqueous solution which comprised 12% of the sodium salt of PAA and 10% of the sodium salt of a sulfonated naphthalene-formaldehyde condensation product.

EXAMPLE 2

Cotton knitted goods having a weight per unit area of 250 g/m$^2$ were dyed in the manner described in Example 1, Reactive Blue 116 being used instead of the dyestuff mentioned therein.

A blue dyeing of outstanding levelness was obtained. The dye liquors employed had a very good stability, as a result of which no staining in the dyeing apparatus and therefore no specks on the dyed material were formed.

EXAMPLE 3

Bleached cotton gabardine having a weight per unit area of 260 g/m$^2$ were dyed by the cold pad-batch process at a liquor pick-up of 80%, a liquor which comprise 30 g of Reactive Green 021, 2.5 g of PAA, 2 g of a commercially available wetting agent (for example a reaction product of isotridecanol with 6 mol of ethylene oxide), 20 g of sodium carbonate and 3 g of sodium hydroxide solution of 38° Be per liter being used. The batching time of the material in the wet state was 48 hours. After washing out, a green dyeing of outstanding levelness in which furthermore no so-called side-to-center shading or tailing was to be observed was obtained.

EXAMPLE 4

A woven fabric of cotton/polyester (80:20) was dyed on a beam dyeing apparatus in a liquor ratio of 1:14 by the two-bath process. The first bath here comprised, in addition to 0.385% (based on the textile material) of Disperse Yellow 042 and 1.9% of Disperse Blue 060, 1 g/l of the PAA amide described below as a dispersing agent, and 0.5 g/l of a commercially available leveling agent (for example a 1:1 mixture of stearic acid x6 EO and nonylphenol x10 EO). Dyeing was started at 80° C. The bath was heated up to 130° C. at a rate of heating up of 1° C./minute, and dyeing was carried out at this temperature for 45 minutes. The fabric was then dyed with a second bath at 80° C. which initially comprised 2.0 g/l of the PAA amide solution described below and to which 0.0096% (based on the textile material) of Reactive Yellow 111 and 3.319% of Reactive Green 021 were added after 10 minutes. After in each case 30 minutes, 80 g/l of sodium chloride, 2 g/l of sodium carbonate and finally, slowly, 4 ml/l of sodium hydroxide solution (38° Be) were then added in succession to the dyebath. After a further half an hour, a dyeing of absolute surface levelness was obtained. Filter effects in the inner layers of the beam dyeing were avoided due to the high stability of the dye liquors.

The PAA amide employed was prepared by heating 48.4 parts of polysuccinimide and 40.5 parts of oleylamine in 103 parts of N-methylpyrrolidone to 130 to 135° C. and stirring the mixture at this temperature for 5 hours. After cooling to 90 to 95° C., 295 parts of water and 28 parts of 50% strength sodium hydroxide solution were added and the mixture was subsequently stirred at 95 to 100° C. for about a further hour. About 500 parts of a 20% strength solution of the PAA amide were obtained as a slightly cloudy solution, which could be converted into a clear solution by clarifying filtration.

The dyeing was to be carried out with the same success if 2 g/l of a composition which comprised 12% of a sulfonated naphthalene-formaldehyde condensation product, 10% of polyaspartic acid Na salt and 78% of water were employed in the reactive dyebath instead of this PAA amide.

What is claimed is:

1. A method for dyeing or printing textile materials of wool, cotton, regenerated cotton, jute, sisal, polyester, polyamide, polyurethane, polyacrylonitrile or polypropylene fibers, or mixtures thereof, which comprises applying to said textile materials a dye liquor or printing paste comprising, as an auxiliary, polyaspartic acid or a derivative thereof selected from the group consisting of polysuccinimide and the $Li^{\oplus}$, $Na^{\oplus}$, $K^{\oplus}$, $Mg^{\oplus\oplus}$, $Ca^{\oplus\oplus}NH_4^{\oplus}$, $H_3N(CH_2CH_2OH)^{\oplus}$, $NH(CH_2CH_2OH)_2^{\oplus}$ and $HN(CH_2CH_2OH)_3^{\oplus}$ salts of polyaspartic acid; and one or more further components selected from the group consisting of wetting agents, emulsifiers, leveling agents, dispersing agents, reducing agents, oxidizing agents, solubilizing agents, defoamers, resist agents, pH regulators and complexing agents, said auxiliary being present in said dye liquor or printing paste in an amount of 0.2 to 10.0% by weight of textile material being dyed or printed.

2. The method of claim 1, wherein the further component (s) comprise 50–90% by weight of the auxiliary.

3. The method of claim 1, wherein said textile material is bleached cotton yarn and said dye liquor or printing paste comprises Reactive Blue 116, a sodium salt of polyaspartic acid and a sodium salt of a sulfonated naphthalene-formaldehyde condensation product.

4. The method of claim 1, wherein essentially a β-polyaspartic acid having a molecular weight of 500 to 10,000, understood as the weight-average, is employed as the polyaspartic acid.

5. The method of claim 1, wherein said textile material is bleached cotton gabardine and said dye liquor or printing paste comprises Reactive Green 021 and polyaspartic acid.

6. The method of claim 1, wherein said polyaspartic acid comprises carboxyl groups which are in the form of an amide.

7. The method of claim 1 wherein said wetting agents, emulsifiers or dispersing agents are selected from the group consisting of reaction products of aliphatic, araliphatic or aromatic hydroxy compounds, carboxylic acids, carboxylic acid amides or amines with ethylene oxide, sulfuric acid half esters or phosphoric acid partial esters thereof, fatty acid esters of mono- or polysaccharides or fatty acid sorbitan esters and oxyethylation products thereof, $C_{10}$–$C_{20}$-alkanesulfonates, $C_8$–$C_{12}$alkylbenzenesulfonates, $C_8$–$C_{18}$-alkyl sulfates or phosphates and condensed aromatic sulfonic acids; said solubilizing agents are selected from the group consisting of glycols, mono- to tetraalkylene glycols and ethers or esters thereof with $C_1$–$C_4$ carboxylic acids; and said defoamers are vegetable oils or mineral oils.

8. The method of claim 1, wherein said textile material is bleached cotton yarn and said dye liquor or printing paste comprises Reactive Green 021, a sodium salt of polyaspartic acid and a sodium salt of a sulfonated naphthalene-formaldehyde condensation product.

9. The method of claim 8, wherein said sodium salt of polyaspartic acid and said sodium salt of a sulfonated naphthalene-formaldehyde condensation product are added to said dyeing composition in the form of an aqueous solution comprising 12% by weight of said sodium salt of polyaspartic acid and 10% by weight of said sodium salt of said sulfonated naphthalene-formaldehyde condensation product.

* * * * *